United States Patent [19]

Evans

[11] 4,076,086

[45] Feb. 28, 1978

[54] FISHING JAR FOR ACCOMMODATION OF EXCESS TENSILE LOAD

[75] Inventor: Robert W. Evans, Houston, Tex.

[73] Assignee: Baker International Corporation, Orange, Calif.

[21] Appl. No.: 757,358

[22] Filed: Jan. 6, 1977

[51] Int. Cl.[2] ..... E21B 1/10

[52] U.S. Cl. ..... 175/297

[58] Field of Search ..... 175/296, 297

[56] References Cited

U.S. PATENT DOCUMENTS 3,851,717 12/1974 Berryman ..... 175/297

*Primary Examiner*—James A. Leppink

*Attorney, Agent, or Firm*—William C. Norvell, Jr.

[57] ABSTRACT

A fishing jar is provided for removing stuck objects from a well bore wherein an upward strain on the running string compresses hydraulic fluid in a compression chamber to the amount of the upward jar or impact load desired to be applied to the fish stuck in the well. A pressure relief mechanism is provided to transfer compressed hydraulic fluid within the compression chamber to automatically activate the jarring mechanism when the load on the jar exceeds the recommended operating load. In a preferred form, the relief mechanism is provided in a piston means which has a normally activated flow regulator bypass means therein together with the pressure relief mechanism. The piston means also includes seal means which define cross sectional areas adjacent each end of the piston means that are of different sizes and are responsive to the compressed hydraulic fluid to move it through the pressure relief mechanism and/or the flow regulator by-pass means in the piston means, and thereby move the piston means in the compression chamber to contact and open a valve which substantially instantaneously releases the compressed hydraulic fluid so that a jar or impact is applied to the fish.

82 Claims, 9 Drawing Figures

Fig. 3
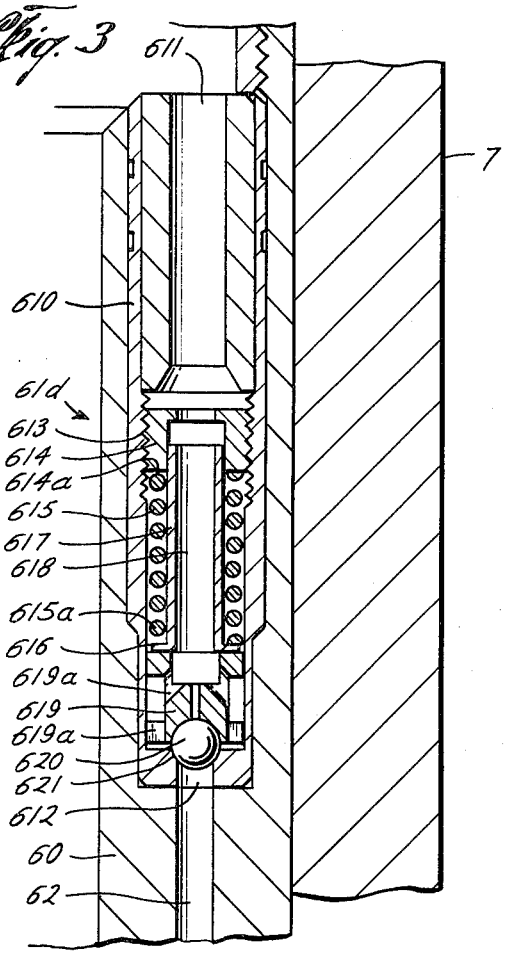
Fig. 3A
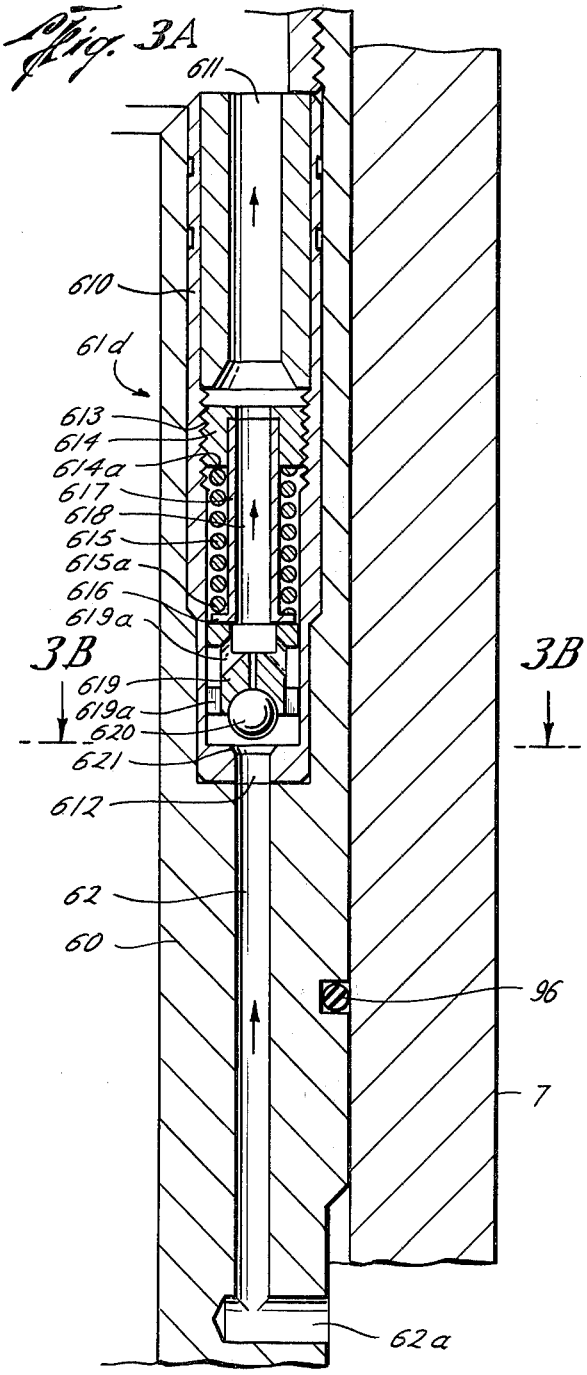
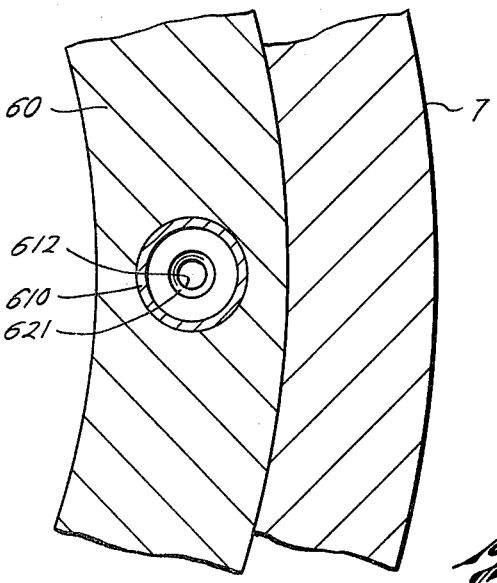
Fig. 3B

FISHING JAR FOR ACCOMMODATION OF EXCESS TENSILE LOAD

BACKGROUND OF THE INVENTION

1. Field of the Invention

The present invention relates to a hydraulic jar mechanism incorporating valve means for automatic tripping of the mechanism to prevent failure of the tool by tensile overload.

2. Description of The Prior Art

Various types of fishing jars are employed for removing some tool or tubular member or other object from a well bore in the earth. The object stuck in the well bore is commonly referred to as a "fish" and fishing jars are run at the lower end of a string of drill pipe or tubing which ordinarily is referred to as the fishing, running or working string and the fishing tool is engaged with the lower end thereof. The fishing tool may be a spear, or overshot or similar device adapted to engage the "fish" so that the fish may be jarred loose by the jar and thereafter retrieved from the well bore.

Jars are employed for the purpose of applying hammer blows to aid in releasing the stuck fish while the fishing string is under tension. Jars of the hydraulic type, in general, are quite well known and comprise telescoping members. When telescoped, a pressure chamber containing a quantity of hydraulic fluid resists elongation of the jar. However, when an upward strain or tension is applied to the running string, the hydraulic fluid is compressed and bleeds through a restricted flow passage thus permitting a gradual telescoping of the tool until a large by-pass is opened and the induced pressure on the hydraulic fluid is instantaneously released. Since the fishing string is no longer resisted by the compressed fluid, the jar telescopes rapidly until such telescoping is stopped by engagement of a hammer and anvil that form part of the fishing jar.

Fishing jars presently employed can deliver various amounts of upward impacts or jarring loads to the fish; however, with all fishing jars presently known to applicant, it is possible to inadvertently or intentionally overload the jar and exceed the tensile strength of the particularly designed tool, resulting in the tool bursting, parts collapsing and/or seals being destroyed.

One object of the present invention is to provide a hydraulic jar wherein the tripping or actuating mechanism is functionally insensitive to an amount of load applied to the jar in excess of the design limits of the tool.

Another object of a preferred form of the present invention is to provide a hydraulic fishing jar which, under application of normal load, has a constant time delay regardless of the load applied to the fishing jar within the range of the design limitations of the particular size jar and incorporates the pressure relief mechanism for protection against tensile overload.

Yet a further object of the present invention is to provide a fishing jar for removing stuck objects from a well bore in which hydraulic fluid within a compression chamber is compressed by the jar load through the tool which may, in fact, exceed the recommended operating load strength of the tool, but which may not, of course, exceed the tensile of the tool, without requiring any initial setting or adjustment by an operator at the earth's surface, or any adjustment of the hydraulic jar once it is in operation.

Yet a further object of the present invention is to provide a fishing jar for removing stuck objects from a well bore in which hydraulic fluid within a compression chamber is compressed by a tensile load either within or exceeding the maximum recommended operating load of the jar without requiring any initial setting or adjustment by an operator at the earth's surface, or any adjustment of the hydraulic jar once it is in operation and wherein such jar includes spaced cross sectional areas in the chamber of a different size which are responsive to the compressed hydraulic fluid for passing the compressed hydraulic fluid through a flow regular by-pass means and, when the maximum allowable load is approached, a pressure relief mechanism, to effect movement of a piston to open a valve and release the compressed hydraulic fluid through a by-pass so that a jar may be applied to the fish.

Yet a further object of the present invention is to provide a fishing jar for removing stuck objects from a well bore in which hydraulic fluid within a compression chamber is compressed by a piston to the jar load applied through the tool without requiring any initial setting by an operator at the earth's surface, or any adjustment of the hydraulic jar once it is in operation and wherein such jar includes spaced cross sectional areas in the chamber of a different size which are responsive to the compressed hydraulic fluid for passing the compressed hydraulic fluid through a flow by-pass means and a pressure relief mechanism in a piston to effect movement of the piston to manipulate a valve and release the compressed hydraulic fluid so that a jar may be applied to the fish, said spaced cross sectional areas being of a predetermined relationship for controlling the compressed hydraulic fluid pressure differential in the chamber acting through the flow by-pass means and the pressure relief valve to move the piston with a minimum of pressure differential in the compression chamber acting through the flow by-pass means and the relief valve and with a minimum metering stroke of the jar.

Still another object of the present invention is to provide a hydraulic jar of relatively simple construction which should be normally substantially foolproof to tolerate any amount of load attempted to be applied to the tool.

Other objects and advantages of the present invention will become apparent from the following description and drawings.

BRIEF DESCRIPTION OF THE DRAWINGS

FIG. 3 is a fragmentary sectional view showing a pressure relief valve means mounted in the piston means, the valve means being in closed position, FIG. 3 being also a view taken from the opposite frontal side of the tool as shown in FIGS. 1A through 2C.

FIG. 3A is a view similar to that of FIG. 3, showing the pressure relief valve means in open position.

FIG. 3B is a cross sectional view of the pressure relief valve means taken along lines 3B — 3B of FIG. 3A.

SUMMARY OF THE INVENTION

The present invention provides a hydraulic fishing jar which is adapted to be run into a well on a fishing string and connected to a fish which is stuck in the well bore. The present jar comprises inner and outer telescopically interengaged bodies having means defining between said bodies a hydraulic fluid chamber preferably having at least three associatable fluid chamber members. Power means are provided in the hydraulic fluid chamber which are operable upon tensioning the fishing string for telescopic movement of said bodies to compress and apply a predetermined force to the hydraulic fluid in a plurality of said fluid chamber members. By-pass flow passage means are provided in one of the inner and outer bodies. A valve means is provided in the chamber for normally closing off one end of the by-pass flow passage means from the compressed fluid in the chamber and is shiftable to open position so that the compressed hydraulic fluid is released to the by-pass flow passage means. Flow by-pass means are provided in the tool to transfer the compressed hydraulic fluid in the chamber and thereby move such fluid in said chamber to engage and move said valve means to open the by-pass flow passage means at one end to the compressed hydraulic fluid upon application of the predetermined force. Pressure relief means which are activatable at forces substantially in excess of predetermined force are provided to meter fluid therethrough and to transfer fluid pressure resulting from said excess force and, when using a preferred design concept, within one of said plurality of hydraulic fluid chamber members to another of said plurality of hydraulic fluid chamber members whereby the valve is engaged and moved to open the by-pass flow passage means at one end of the compressed hydraulic fluid chamber. Hammer and anvil means are provided on the bodies and are movable into engagement when the valve member and the valve means open the by-pass passage means to the chamber across said flow by-pass means. The present apparatus provides, by the construction above identified, an apparatus which tolerates attempts to apply a load in excess of those acceptable to the unit and not within the design limitations of the tool, such that the tool responds to the load limit and jars, even when applications of load in excess of the limit are attempted to be applied to the tool.

DESCRIPTION OF THE PREFERRED EMBODIMENT

Figure 1A:
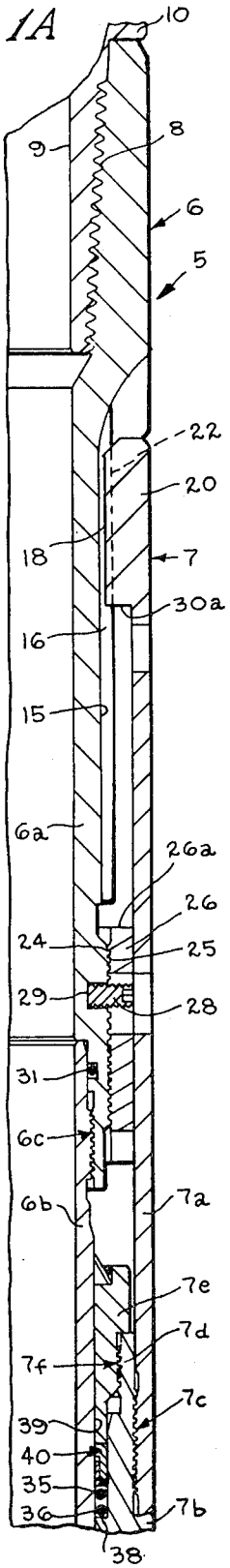
FIGS. 1A through 1C together constitute generally a longitudinal partial quarter section of a jarring tool of the preferred form of the present invention installed in a fishing string and illustrates the position of the components when the tool is in a collapsed or telescoped relation.

The hydraulic fishing jar of the present invention is referred to in FIG. 1A generally by the numeral 5. It comprises an elongated tubular inner mandrel or body 6 and an outer tubular elongated body or housing 7. The inner body 6 at its upper end is provided with a threaded box 8 of well known configuration which is adapted to receive the externally threaded pin 9 at the lower end of the upwardly extended section of drill pipe or drill collar or other tubular member 10 constituting a portion of the running or fishing string on which the jar 5 is run into the well bore, and by which the jarring tool is operated to provide a jarring action for a fishing tool which may be designated F connected to the threaded end 13 on the lower end of the outer housing or body 7 as more clearly seen in FIG. 1C.

The inner housing or body 6 is provided adjacent its upper end with a plurality of elongated circumferentially spaced grooves 15 having longitudinally extending projections 16 extending between the grooves which elongated, circumferentially spaced grooves 15 are adapted to receive the circumferentially spaced projections 18 formed on the annular member 20 adjacent the upper end of the outer body or housing 7. The circumferentially spaced projections 18 are provided with elongated recesses therebetween illustrated at 22 for receiving the elongated circumferentially spaced projections 16 on the inner body 6. This arrangement provides a splined configuration for enabing the inner body 6 and outer body 7 to telescope longitudinally relative to each other while inhibiting relative rotation therebetween.

It can be appreciated that the grooves 15 and projections 16 will be of any suitable or longitudinal extent to accommodate the desired telescoping movement of the inner body 6 and outer body 7 for compression of the hydraulic fluid in the compression chamber and for release thereof to enable an upward blow to be delivered to the fish in a manner as will be described in greater detail.

An annular member 26 is secured on the body 6 below the spline arrangement hereinbefore described, by means of the threads 24 formed on the inner body 6 and threads 25 formed on the annular member 26. Also, if desired, such member may be further secured in place by the threaded pin 28 extending through the member 26 and into a suitably threaded opening 29 in the inner body 6.

The upper annular end **26*a* of the member 26 forms the hammer for delivering an upward impact when the inner body 6 is released relative to the outer body 7** as will be described.

The inner body 6 comprises a plurality of longitudinally tubular portions secured together including the portion **6*a* and to which is secured the tubular, longitudinally extending portion 6*b*, by suitable means such as the cooperating threads on 6*a* and 6*b* referred to at 6*c***.

A suitable seal 31 is interposed between unthreaded portions of the cylindrical surfaces of **6*a* and 6*b* for sealing therebetween. Threadedly secured to the lower end of the tubular section 6*b* is the tubular section 6*d* which forms the lower end of the inner tubular body or housing 6. Suitable cooperating threads referred to generally at 6*e* formed on the tubular inner body portion 6*d* and tubular inner body portion 6*e* enable them to be threadedly connected together and suitable seal means as shown at 32 and provided between the unthreaded portions of the cylindrical surfaces of the members 6*b* and 6*d*** for sealing therebetween.

Figure 2A:
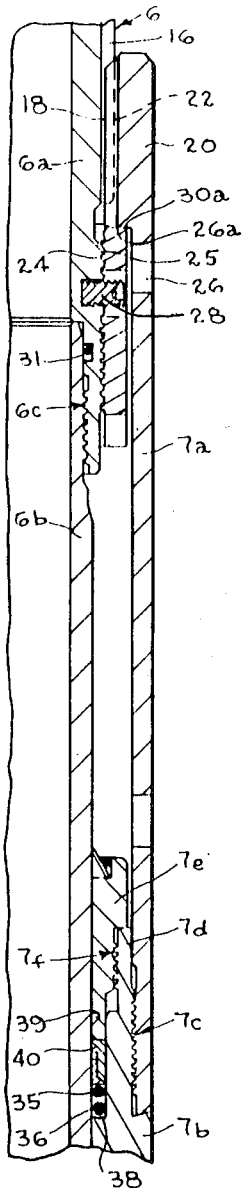
FIGS. 2A through 2C together constitute a fragmentary, generally longitudinal quarter section through portions of the jarring tool illustrated in FIGS. 1A and 1C, FIGS. 2A through 2C illustrating the components when the tool is extended and at the moment that an upward impact is delivered to the fish.

The outer tubular body or housing 7 includes the uppermost tubular portion **7*a* on which are formed the circumferentially spaced projections 18 with the recesses 22 therebetween as previously described. The lower annular end 30*a* on member 20 forms an anvil against which hammer 26*a* strikes to deliver a jar as will be described. The upper outer body portion 7*a* is threadedly connected to the next adjacent outer tubular body portion 7*b* by suitable cooperating threads referred to generally at 7*c* formed on the lower end of 7*a* and at the upper end of 7*b* as shown in FIG. 1A of the drawing. The portion 7*b* includes the upwardly extending annular projection 7*d* which is threadedly engaged with the annular member 7*e* by means of the threads referred to generally at 7*f* formed on the extension 7*d*** and the annular member 7e as shown in FIG. 1A. It will be noted that the annular member 7e surrounds and slidably engages the inner tubular body 6 and more particularly the tubular body portion 6b as shown in FIGS. 1A and 2A of the drawings.

Figure 1B:
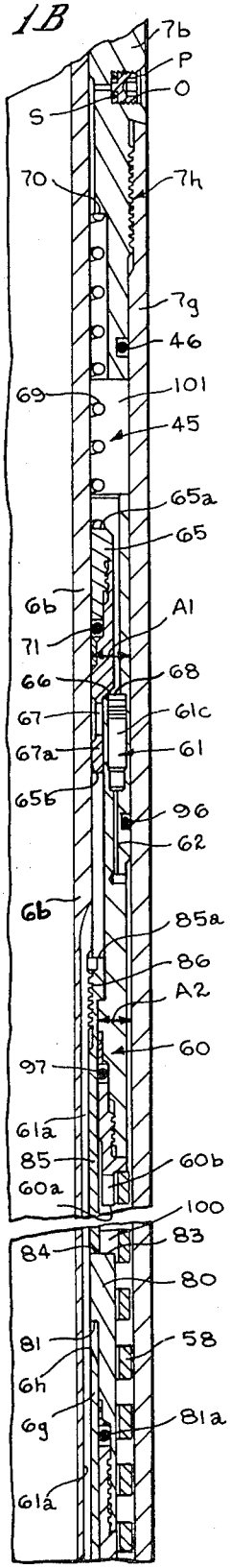
Figure 1C:
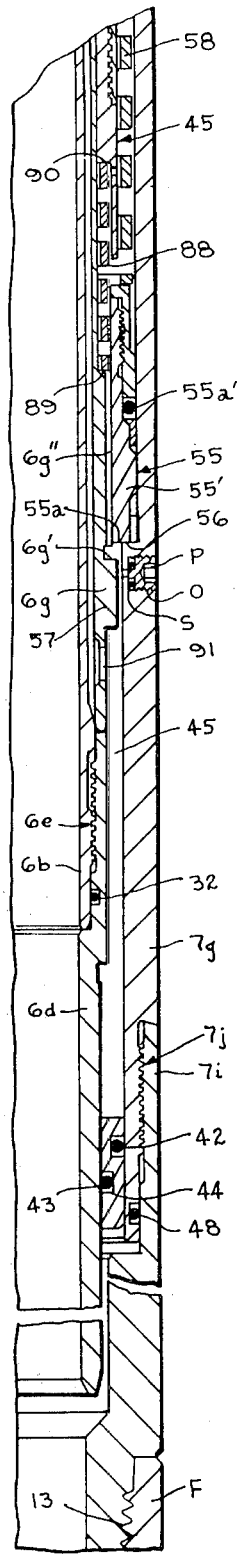

Suitable seal means comprising the annular seal rings 35 and 36 are positioned on the shoulder 38 of the member 7b adjacent the cylindrical surface 39 of the member 6b and are retained in position by the annular member 7e and retainer 40. The seal means 35 and 36 provide means which define the upper end of a hydraulic fluid chamber referred to generally at 45 in the drawings. Such chamber extends longitudinally from the seal means 35, 36 betwen the inner body 6 and outer body 7 to the seal means 42 and 43 carried in the annular floating piston 44 at the lower end of the jar 5 in the annular space between the inner body 6 and the outer body 7 as shown in FIG. 1C. Suitable openings O are provided for filling chamber 45 and bleeding air therefrom as such filling occurs. The plugs P may then be threadedly engaged in the openings O, with a suitable seal ring S thereon to prevent loss of fluid.

The outer tubular body portion 7b is connected to the outer tubular body portion 7g by suitable means such as the cooperating threads formed on the lower end of the outer body portion 7b and the upper end of the outer body portion 7g, which cooperating threads are referred to generally by the numeral 7h. Suitable seal means 46 are provided between the unthreaded cylindrical surfaces of the members 7b and 7g to maintain pressure integrity. The outer tubular body portion 7g is connected at its lower end to the outer tubular body portion 7i by suitable means such as the cooperating threads adjacent the lower end of the outer tubular body portion 7g and the upper end of the outer tubular body portion 7i, such threads being referred to generally by the numeral 7j. Suitable seal means as shown at 48 are provided between the unthreaded cylindrical surfaces of the outer tubular body portions 7g and 7i to maintain pressure integrity.

As previously noted, the threaded end 13 of the outer tubular body 7i is provided for connecting with the fishing tool F of a suitable type.

Figure 2B:
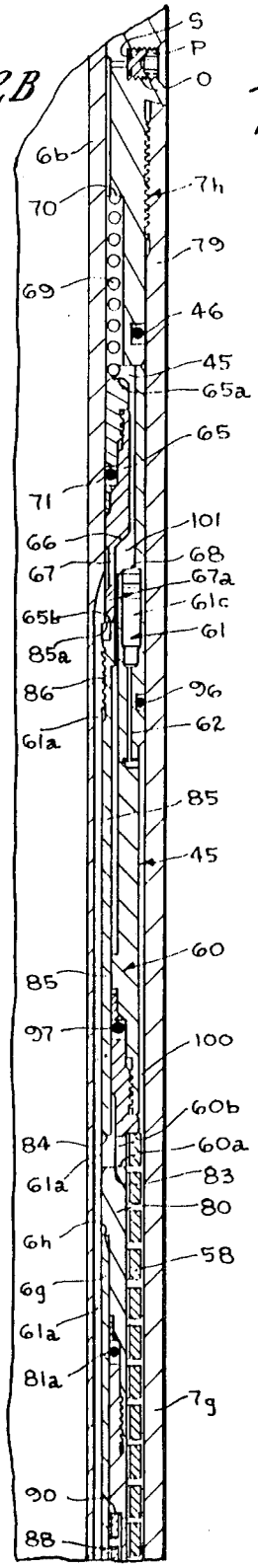

Power piston means are referred to generally at 55 and include the annular element 55' and the annular enlargement 57 on body portion 6g, which cooperate to provide a valve arrangement in the power piston 55 as will be described. The annular element 55' is between the outer body 7 and inner body portion 6g and is spaced radially from the outer surface of 6g to form a flow passage 6g'' therebetween as shown in FIG. 1C when the element 55' is spaced from enlargement 57. The element 55' is supported on the annular shoulder 56 formed in outer body portion 7g. Suitable seal means 55a' seal between element 55' and the inner cylindrical wall of housing 7. The annular element 55' of power piston 55 is retained in position on the shoulder 56 when the jar of the present invention is in the collapsed position shown in FIGS. 1A–1C by means of the spring 58 extending longitudinally of the chamber 45. The spring at its upper end abuts an annular shoulder on the lower end of piston means referred to generally by the numeral 60, which piston means also is slidably mounted within the chamber 45 as shown in FIGS. 1B and 2B.

The piston means 60 includes piston valve means 65, substantially constant flow by-pass means referred to generally at 61 and the passage means 62 for by-passing fluid across the piston means 60 in a manner as will be described.

The piston means 60 also includes a pressure relief valve mechanism 61d as shown in FIGS. 3, 3A, and 3B, which is carried in passage means 62a in annular piston means 60 at a position circumferentially spaced relative to constant flow by-pass means 61. The pressure relief valve mechanism, as depicted in the drawings, is of conventional construction, well known to the valve art, and readily and commercially available. The mechanism 61d is comprised of an outer elongated housing 610 having at its upper end a flow passage 611 communicating with the pressure chamber 101 thereabove and a companion flow passage 612 at its lower end for fluid communication with the pressure chamber 100 below the constant flow by-pass means 61. The mechanism 61d has affixed to the housing 610 by means such as threads 613 a spring seat 614 which engages at its lower end 614a a circumferentially extending spring element 615 which, in turn, abuts at its lower end 615a a companion spring seat 616. A cylindrical member 617 encircles the spring 615 to form a housing therefor together with a portion of the main or central housing 610. In addition, the housing 617 also defines a flow passageway 618 within the mechanism 61d. Immediate the lower spring seat 616 is a ball cage element 619 having flow passages 619a therethrough for selective transmission of fluid. The element 619 primarily functions to house a ball element 620 and, by means of force exerted on the housing 617 by the expansive urging of the spring 615, sealingly engages the ball element 620 upon its companion seat 621 defined within the lower end of the housing 610. The load on the spring 615 is selective, such that the ball element 620 is permitted to disengage away from its seat 621 as pressure therebelow exceeds the load on the spring element 615 to permit fluid to travel within the valve from chamber 100, through the passage 612, the passages 619a, the flow passageway 618, and thence out of the pressure relief mechanism 61d by means of the flow passage 611 at the top thereof to the chamber 101.

It is not essential to the present invention that the mechanism 61d be placed within a piston, such as 60. In fact, it is not essential that piston means are utilized. It is only essential to this aspect of the invention that a mechanism functioning as 61d be placed in the tool to release pressure in excess of the recommended operating load to trip the jarring mechanism, as depicted below.

The annular piston valve means referred to at 65 is provided with an annular surface 66 for sealably engaging with the upper end 68 of the piston means 60 as illustrated in FIG. 1B of the drawings. The piston valve means 65 includes a plurality of circumferentially spaced flow ports 67 formed in the annular projection 67a which, when the piston valve means 65 is seated on the end 68 of piston means 60, extends beyond the end 68 of piston means 60 and between such piston means and body portion 6b. This prevents communication of ports 67 with chamber portion 101. The piston valve means 65 is urged towards seated position on the upper end 68 of the piston means 60 by means of the resilient means 69 which abuts the shoulder 70 on the outer housing body portion 7b at one end, with its other end resting on the end 65a of the valve means 65. The annular valve means 65 is slidably arranged on the inner body 6 and more specifically the inner body portion 6b as shown in FIG. 1B and is provided with seal means 71 for slidably and sealably engaging with the outer cylindrical surface of the member *6b*.

A valve member 80 is carried in chamber 45 beneath the annular piston means 60 and in spaced relation thereto.

The lower most inner body portion *6d* abuts an annular upwardly extending annular skirt *6g* which skirt thus is part of inner body 6 and extends longitudinally of, and surrounds, the lower most inner body portion *6b* as shown in FIGS. 1B and 1C of the drawings.

The upper end *6h* of the extension *6g* terminates in spaced relation to the annular shoulder 81 formed on the valve member 80 as shown in FIG. 1B and the valve member 80 is slidable relative to the upwardly extending body portion *6g* as shown in FIGS. 1B and 1C. Suitable seal means as shown at 81*a* are provided between the cylindrical surface of *6g* and the valve member 80 so that the valve member 80 is thus sealably and slidably carried by the inner body 6.

The upper end 83 of the valve member 80 seats against the lower end 84 of the annular skirt means 85 which is secured by any suitable means such as threads 86 or the like to the tubular portion *6b* of the inner body 6 and thus forms a part of the inner body 6.

When the components of the jar of the present invention are in the relative position as shown in FIGS. 1A through 1C, it will be noted that the resilient means 88 supported on the shoulder 89 of the annular skirt *6g* engages the annular shoulder 90 on valve member 80 to urge the valve member 80 upwardly into sealing contact with the lower end 84 of the annular skirt means 85 and to maintain 57 in spaced relation to element 55' when the inner and outer bodies of the tool are collapsed relative to each other.

It will be further noted that by-pass flow passage means 61*a* extends from immediately above the end 85*a* of the means 85 and extends longitudinally therebeneath as well as beneath the annular skirt *6g* carried on inner body portion *6d* so as to communicate with the lower end of the chamber 45 through the port means 91 formed in skirt *6g* beneath power piston 55 as shown in FIG. 1C.

Suitable seal ring means 96 are provided between the annular piston means 60 and the outer body 7 and additional seal ring means 97 are provided between the piston means 60 and inner body 6. It will be noted that the seal 96 sealably and slidably engages the inner cylindrical surface of the outer body portion *7g* while the seal 97 engages the outer cylindrical surface of the means 85 secured to and forming part of the inner body 6.

Although not essential to the use of the present invention, a constant flow regulating means referred to generally at 61 is provided and includes a substantially constant flow regulating valve 61*c* of well known configuration which will transfer compressed hydraulic fluid from the hydraulic compression chamber 100 to the hydraulic compression chamber 101 at substantially a constant flow rate so long as the pressure differential of the hydraulic fluid between compression chamber 100 and compression chamber 101 is within a predetermined range. By way of example only, when the pressure differential between chambers 100 and 101 is greater than approximately 50 p.s.i. differential, but less than approximately 3,000 p.s.i. differential, the flow rate from chamber 100 to chamber 101 is constant at 0.3 gallons per minute for a given tool size. Since such flow regulator is of well known construction and may be obtained commercially, it is not deemed necessary to give a detailed description as it is well known to those skilled in the art.

In order to maintain the proper hydraulic pressure differential between compression chamber 100 and compression chamber 101, seal means are provided in the chamber 45 between the piston valve means 65 and said inner body 6 and between said piston means 60 and the outer body *7g* and between the piston means 60 and means 85 to provide cross sectional areas respectively adjacent each end of the piston means in the compression chamber 100 and compression chamber 101 which are responsive to the compressed hydraulic fluid for passing the compressed hydraulic fluid through said constant flow by-pass means 61 at substantially a constant rate and with a given pressure differential for any load applied to the jar.

More particularly, the seal means 71 in the annular piston valve means 65 which engages inner body portion *6b* and the seal means 96 between the piston means 60 and outer housing portion *7g* define one effective cross sectional area adjacent one end of the piston means 60 responsive to compressed hydraulic fluid within the compression chamber 101 and which is illustrated at A1, in FIG. 1B. Similarly, seal means 96 between the piston means 60 and outer housing portion *7g* and seal means 97 between the piston means 60 and the means 85 define an effective cross sectional area illustrated at A2 adjacent the other end of the piston means 60 responsive to compressed hydraulic fluid in compression chamber 100. The jar is designed and constructed so that cross sectional area A1 defined by the seals 71 and 96 is larger than the cross sectional area A2 defined by the seals 96 and 97.

When hydraulic fluid is compressed in the chamber between the inner body 6 and outer body 7, the forces acting on the piston means 60 will tend to balance, and the hydraulic pressure in the compression chamber 100 beneath the piston 60 is greater than that in compression chamber 101 above the piston means 60 due to the difference between A1 and A2. Thus, when a load is applied to the hydraulic column in chamber 45 by the inner tubular member and power piston 55 to compress the hydraulic fluid and cause a pressure differential from chamber 100 to chamber 101, fluid will be displaced from the compression chamber 100 to the compression chamber 101 through the constant flow by-pass means 61 carried by the piston 60 and, when the tensile strength of the jar is approached, also through the pressure relief mechanism 61*d*.

During normal operation of the tool and within the tensile load design of the tool, as fluid is displaced from beneath the piston means 60 to the top of the piston means 60, the piston means 60 will travel downwardly at a fixed rate of travel in the compression chamber portion 100.

When piston means 60 engages valve member 80 and moves it off the seat 84, compressed hydraulic fluid from chamber 100 is discharged through by-pass flow passage 61*a* to chamber portion 45*a* beneath power piston 55. Normal release of the compressed hydraulic fluid permits the inner mandrel 6 to move upwardly until the end 85*a* of means 85 engages the lower end 65*b* of the valve means 65 and moves it away from piston means 60, so that compressed fluid from chamber 101 is conducted to by-pass 61*a*. The inner body 6 continues its upward movement so that hammer 26*a* strikes an upward blow on anvil 30*a*.

DESCRIPTION OF OPERATION

Figure 2C:
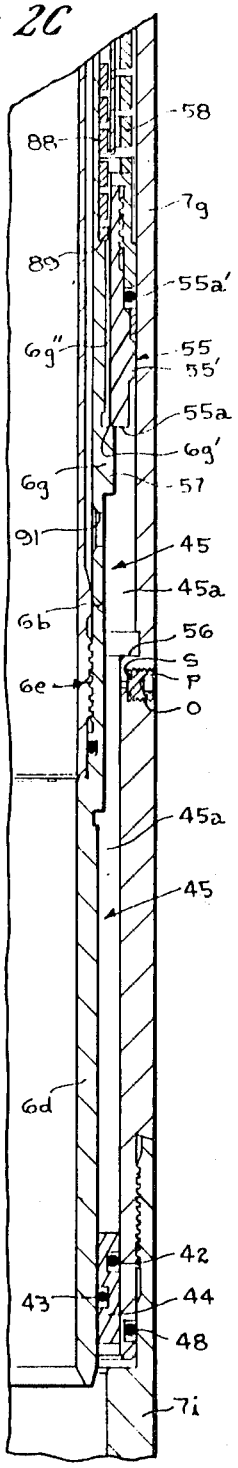

Referring to FIGS. 2A through 2C, the components of the jar 5 of the present invention are shown in their relative position at the time that an upward jarring blow is delivered by the jar to a fish engaged by fishing tool F. In order to deliver an upward jarring blow to a fish in a well bore, the fishing tool F is first engaged with the stuck fish when the operating string is lowered into the well bore. Thereafter an upward strain is taken on the fishing or operating string at the earth's surface in a predetermined amount. For example, in a tool of the present design of 4¼ inch outer diameter of the outer tubular body 7, the maximum recommended operating load or jar that may be applied to a fish is 55,000 pounds due to the physical limitations and strength of the materials involved. However, any load in excess of this maximum recommended operating load for the tool may be accepted by the present invention without any adverse affects to the components of the tool up to the predetermined and maximum load allowable by the pressure relief mechanism 61*d*.

In the design shown in the FIGS., during normal operation, there is a relatively constant time delay from the time that the desired load is applied by the fishing string until the jar is released to deliver an impact to the fish and the relatively constant time delay is independent of downhole temperatures and pressures.

As an upward strain or pull is applied at the earth's surface to the fishing string 10 illustrated in FIG. 1A of the drawings, this is transmitted through the inner body 6 and its body portions previously described. The outer body 7 will remain stationary since it is connected by its respective outer body portions to the fishing tool F which, in turn, is secured to the fish to which the upward jarring impacts are to be delivered.

Upward movement of the inner body 6 including body portions 6*a*, 6*b*, 6*d*, and 6*g* moves the shoulder 6*g*′ on enlargement 57 into sealing engagement with the lower end 55*a* of annular element 55′. When 57 and 55′ are thus sealingly engaged, passage 6*g*″ is closed off and the power piston means formed by 57 and 55′ compresses the hydraulic fluid in compression chambers 100 and 101, since chamber 45 referred to as 45*a* beneath power piston 55 is isolated from the compression chamber, including compression chambers 100 and 101 on each end of piston means 60. Thus, the desired jarring load is transmitted to the hydraulic fluid within such compression chamber defined by chambers 100 and 101 to compress it.

If it is desired to apply a jarring load of 20,000 pounds to the stuck fish, then the operating string will be pulled at the earth's surface to compress the hydraulic fluid by power piston means 55 in jar 5 until the weight indicator at the earth's surface indicates that such load is present in the compressed hydraulic fluid, of course, such weight indicator indicating the 20,000 pounds load plus the weight of the working string in the well bore.

Under either abnormal conditions, or because the maximum recommended operating load of the jar has been ignored, a load in excess of this operating load may be applied. For example, the driller may inadvertently apply a load of 65,000 pounds to the jar. When this occurs, the driller at the earth's surface will set his brake and due to the difference in the cross sectional area between A1 on one side of the piston means 60 and A2 on the other side of the piston means 60, there will be a greater hydraulic pressure beneath the piston means 60 in compression chamber 100 than above piston means 60 in compression chamber 101 so that hydraulic fluid flows through the constant flow by-pass means 61 in piston means 60 to the compression chamber 101 above the piston from chamber 100. Additionally, as the maximum load allowable is approached and exceeded, the valve mechanism 61*d* will be activated to bleed off excess pressure in chamber 100 to chamber 101.

Normally, the flow of hydraulic fluid across piston means 60 is at a substantially constant rate due to the constant flow by-pass means 61. However, in the event that a load is applied to the jar which is in excess of the maximum allowable load of the tool, the piston means 60, is caused to quickly travel downwardly by reason of the hydraulic fluid flow through the by-pass means 61 and the pressure relief valve mechanism 61*d*. The normally metered flow of fluid through the by-pass means 61 is dominated by the transfer of fluid flow through the pressure relief valve mechanism 61*d* to interfere with the constant time delay design of the tool shown in the FIGS., to permit rapid longitudinal downward shifting of the piston 60. As the piston means 60, with fluid being ejected through the by-pass means 61 and the valve mechanism 61*d*, moves downwardly, spring 58 yields as the piston means 60 moves relative to the power piston means 55. The movement of piston means 60 continues until its lower end 60*a* tags the top 83 of the valve member 80. At the time that the piston means 60 contacts the top 83 of the valve means 80, there will still be a pressure differential between compression chamber 101 and compression chamber 100 and compressed hydraulic fluid will continue to flow from compression chamber 100 to compression chamber 101 through the by-pass means 61 and the valve mechanism 61*d*. However, since the effective cross sectional area A1 in pressure chamber 101 is larger than the effective cross sectional area A2 in pressure chamber 100, the additional fluid flow from hydraulic compression chamber 100 through the constant flow regulator means at by-pass means 61 and the pressure equalizing valve mechanism 61*d* to compression chamber 101 causes piston means 60 to move further downwardly and move the top 83 and valve means 80 away from the lower end 84 of means 85. When this occurs, by-pass flow passage 61*a* is caused to be in communication with chamber 45*a* and compression chamber 100, and causes dumping of the compressed fluid within the chamber 100.

The inner body 6 along with power piston 55 is permitted to move upwardly substantially instantaneously relative to the outer housing 7 because the compressed hydraulic fluid from compression chamber 100 is immediately dumped by means of the by-pass flow passage 61*a* and ports 91 in 6*g* to the chamber portion 45*a* beneath the power piston 55. The upward movement of inner body portion 6 along with power piston 55 at the time that by-pass flow passage 61*a* communicates with compression chamber 100 moves the upper end 6*h* of 6*g* from the position shown in FIG. 1B to the position shown in FIG. 2B so that end 6*h* engages shoulder 81 of valve member 80. The upward movement of inner body 6 also moves means 85 from the position shown in FIG. 1B to the position shown in FIG. 2B so as to contact the upper end 85*a* of the means 85 on inner body 6 with the lower end 65*b* of the piston valve means 65 and thereby unseat it from engagement with the upper end 68 of piston means 60.

It should be noted that as piston means 60 moves in the compression chamber, valve means 65 remains in sealing engagement with the upper end 68 of piston means 60 until means 85 engages its end 65*b* and unseats it. When this occurs, compressed hydraulic fluid from compression chamber 101 flows through annular spaced port means 67 in valve means 65 to by-pass means 61*a* and ports 91 in 6*g* to the chamber 45*a*, as shown in FIG. 2B.

As previously noted, once communication is established between cosmpression chamber members 100, 101 and 45*a*, the upward movement of inner body 6 relative to outer housing or body 7 is sudden and the inner body 6 continues its rapid, upward movement so that hammer 26*a* strikes a blow against anvil 30*a*.

To further illustrate the operation of the present invention on a 4¼ inch O.D. tool, the cross sectional area at A2 may preferably be 4.643 square inches and the cross sectional area of A1 may preferably be 5.409 square inches. When a load of 80,000 pounds is applied by the operating string 10 as described in the above example, the maximum recommended operating load will be exceeded by 25,000 pounds, the pressure in compression chamber 100 will therefore be approximately 17,230 pounds per square inch and the pressure in compression chamber 101 along piston means 60 will be approximately 14,790 pounds per square inch, thus yielding a pressure differential of 2,440 pounds per square inch between cross sectional area A2 and cross sectional area A1.

If the load of 80,000 pounds is applied through the tool, then the inner body is again tensioned upwardly.

It should be noted that valve member 80 is constructed and arranged so that it is pressure biased towards closed position against the end of means 85 as shown in the drawings, but as long as the difference in cross sectional areas A1 and A2 is substantially greater than the biased area of valve member 80, the piston means 60 will overcome the spring force 88 and bias of the valve member 80 to open it as described.

It can be appreciated that floating piston 44 is a pressure compensating piston to equalize the pressure in chamber 45 with the pressure in the fishing string since the underside of the piston 44 is exposed to the pressure present in the running or fishing string 10.

Piston means 60 travels downwardly during the metering cycle when fluid is displaced upwardly through the constant flow by-pass means 61 and the mechanism 61*d*, as described previously. Since cross sectional area A1 in compression chamber 101 is larger than the cross sectional area A2 in compression chamber 100, the volume in compression chamber 101 opened up by the downward movement of piston means 60 will be larger than that displaced below the piston means 60 as it moves downwardly. To compensate for this, the inner body 6 will move upwardly relative to outer housing 7 (the "metering stroke"), to make up for this difference in volume and the amount it will move up equals the stroke of the piston means 60 relative to inner body 6 times the difference between the cross sectional areas A1 and A2 divided by the cross sectional area A1.

As mentioned previously on a 4¼ inch O.D. tool, the cross sectional area A1 in the example is 5.409 square inches and the cross sectional area A2 in the example is 4.643 square inches and the stroke of the piston means is 4 inches. Therefore the total metering stroke of the present hydraulic jar is 5.409 minus 4.643, divided by 5.409 times 4 which equals 0.567 inches. Thus the metering stroke of the device of the present invention is relatively small compared with prior art devices.

After the tool has been actuated, the inner and outer bodies may be collapsed or moved to the position shown in FIG. 1A–1C. As this occurs, enlargement 57 moves away from element 55' and passage 6*g*'' along with flow regulating valve 61*c*, which is flow reversible, and passage 61*a* enable hydraulic communication in the chamber to be accomplished so that the tool components may be quickly and easily repositioned so that another jar may be applied. The reverse flow feature of the flow regulating valve 61*c* communicates, or passes fluid across piston means 60 from the top thereof to the bottom thereof.

From the foregoing it is also seen that enlargement 57 and element 55' not only cooperate to form the power piston means 55, but also cooperate to form a valve arrangement in the power piston means 55 for closing off flow therearound or for opening for flow across the power piston means 55.

The construction and arrangement of the present invention overcomes the objections of prior art hydraulic jars which meter hydraulic fluid at the full pressure induced by the tensile load on the jar, whether it is 20,000 pounds, 50,000 pounds or any other load, and thus overcomes the problems of heat build up, seal failures, and premature tripping which often occur with conventional hydraulic jars presently known to applicant. More importantly, the additional feature of guaranteed tripping of the jarring mechanism affords protection against an overload of the tool in excess of the tensile load tolerance of the tool design.

Also, the travel of the inner body 6 during the metering stroke is substantially less, as above noted, than that possible with hydraulic jars of present conventional design known to applicant.

Thus, the hydraulic jar of the present invention need only be assembled and filled with hydraulic fluid in chamber 45 and connected in fishing string S for lowering into the well bore. After the fish is engaged by the fishing tool F, any load may be applied to the jar, within or exceeding its maximum recommended operating load, and if the load is within the recommendation, approximately ten to twenty seconds after tension is initiated in the operating string as described herein, the jar will actuate and deliver an impact, the elapsed time being independent of the magnitude of the load and independent of well temperatures and pressures. If the load is in excess of the maximum allowable load, the jarring will be almost instantaneous.

The present invention can be repeatedly employed and the jarring load may be varied, that is, increased or decreased as desired, while the jar remains in the well bore.

All of the foregoing is accomplished without any operator adjustment of the jar; nor is any presetting of the jar required before it goes into the well bore, nor is any adjustment required once the jar is in operation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a hydraulic fishing jar adapted to be run into a well on a fishing string and connected to a fishing tool in the well bore:

(a) inner and outer telescopically interengaged bodies;

(b) means defining between said bodies a hydraulic fluid chamber having at least three associatable fluid chamber members;

(c) means in the chamber operable upon tensioning the fishing string for telescopic movement of said bodies to compress and apply a predetermined force to a plurality of said fluid chamber members;

(d) there being by-pass flow passage means in one of said bodies;

(e) valve means in the chamber for normally closing off one end of the by-pass flow passage means from the compressed fluid in the chamber and responsively activatable to open so that compressed hydraulic fluid is released to the by-pass flow passage means;

(f) flow by-pass means to transfer the compressed hydraulic fluid in the chamber and thereby move said fluid in said chamber to engage and move said valve means to open the by-pass flow passage means at one end to the compressed hydraulic fluid upon application of said predetermined force;

(g) pressure relief means activatable at forces substantially in excess of said predetermined force to meter fluid therethrough and to transfer fluid pressure resulting from said excess force and within one of said plurality of hydraulic fluid chamber members to another of said plurality of hydraulic fluid chamber members whereby said valve is engaged and moved to open the by-pass flow passage means at one end of the compressed hydraulic fluid chamber; and (h) hammer and anvil means on said bodies movable into engagement when said valve member and valve means open the by-pass passage means to the chamber across said flow by-pass means.

2. The invention of claim 1 wherein said flow by-pass means includes piston means, said piston means having seal means sealably and slidably engaged in the chamber to provide cross sectional areas of different size on said piston means responsive to the compressed hydraulic fluid in the chamber for transfer thereof across said piston means.

3. The invention of claim 2 wherein said cross sectional areas are of a predetermined relationship for controlling the compressed hydraulic fluid pressure differential across said piston means in the chamber acting to move said piston means.

4. The invention of claim 2 wherein said piston means is an annular member having top and bottom ends and wherein the cross sectional area defined by said seal means adjacent said bottom piston end is smaller than the cross sectional area defined by said seal means adjacent said top piston means.

5. The invention of claim 2 including resilient means in the chamber urging said piston means away from said valve means and yieldable as said piston means moves to engage said valve means.

6. The invention of claim 5 wherein said resilient means urging said piston means away from said valve means also engages said means in the chamber operable upon tensioning the fishing string and is yieldable upon movement of said piston means relative to said means in the chamber operable upon tensioning the fishing string.

7. The invention of claim 1 wherein said means defining the hydraulic fluid chamber comprises upper and lower seal means between said bodies, one of said seal means being a floating piston for compensating for the pressure of fluid in the well.

8. The invention of claim 1 wherein said valve means is slidably and sealably carried by said inner body.

9. The invention of claim 1 wherein said valve means is slidably and sealably carried by said outer body.

10. The invention of claim 1 wherein said by-pass flow passage means is formed in said outer body.

11. The invention of claim 1 wherein said by-pass flow passage means is formed in said inner body.

12. The invention of claim 2 wherein said piston means is slidably and sealably carried in said chamber.

13. The invention of claim 2 wherein one of said cross sectional areas is defined by seal means between said piston means and inner body and seal means between said piston means and outer body, and the other of said cross sectional areas is defined by seal means between said piston means and outer body and seal means between said piston means and inner body.

14. The invention of claim 2 wherein said cross sectional areas are of a predetermined relationship for maintaining the compressed hydraulic fluid pressure differential across said piston means within a predetermined range.

15. The invention of claim 1 wherein said flow by-pass means includes flow regulator means whereby compressed hydraulic fluid is movable therethrough within the predetermined pressure differential.

16. The invention of claim 15 wherein said flow regulator means is flow reversible.

17. The invention of claim 2 further comprising a flow reversible element for transmission of fluid in the chamber above said piston means to the chamber below the piston means.

18. The invention of claim 17 wherein said flow reversible element comprises a check valve.

19. The invention of claim 1 further comprising a flow reversible element for transmission of fluid in the chamber below the valve means to the chamber above the valve means.

20. In a hydraulic fishing jar adapted to be run into a well on a fishing string and connected to a fishing tool in the well bore:

(a) inner and outer telescopic bodies;

(b) means including longitudinally spaced seals defining between said bodies a hydraulic fluid chamber;

(c) power piston means including an annular piston carried by one of said bodies and shiftable longitudinally in said chamber by the other of said bodies upon tensioning the fishing string for telescopic movement of said bodies to compress and apply a predetermined force to the hydraulic fluid in the chamber;

(d) therebeing by-pass flow passage means in one of said bodies;

(e) a valve member in the chamber for normally closing off one end of the by-pass flow passage means from the compressed fluid in the chamber and shiftable to open so that compressed hydraulic fluid is released to the by-pass flow passage means;

(f) piston means including flow by-pass means to transfer the compressed hydraulic fluid in the chamber across said piston means and thereby move it in the fluid chamber to engage and move said valve member to open the by-pass flow passage means at one end to the compressed hydraulic fluid;

(g) said piston means including valve means normally closing off the other end of by-pass flow passage means and shiftable to open so that hydraulic fluid is released from the chamber above said piston means;

(h) means on said inner body to move said piston valve means and open the other end of the by-pass flow passage means when said valve member is moved to open one end of the by-pass flow passage means to the compressed hydraulic fluid;

(i) hammer and anvil means on said bodies movable into engagement when said valve member and piston valve means open the by-pass passage means to the chamber across said piston means; and (j) pressure relief means associated with said piston means and activatable at forces substantially in excess of said predetermined force to meter fluid therethrough and to transfer fluid pressure resulting from said excess force and within said chamber whereby said valve is engaged and moved to open the by-pass flow passage means to one of the compressed hydraulic fluid chambers.

21. The invention of claim 20 wherein said piston means includes seal means sealably and slidably engaged in the chamber to provide cross sectional areas of different size on said piston means responsive to the compressed hydraulic fluid in the chamber for transfer thereof across said piston means.

22. The invention of claim 21 wherein said cross sectional areas are of a predetermined relationship for controlling the compressed hydraulic fluid pressure differential across said piston means in the chamber acting to move said piston means.

23. The invention of claim 22 wherein said piston means is an annular member having top and bottom ends and wherein the cross sectional area defined by said seal means adjacent said bottom piston end is smaller in size than the cross sectional area defined by said seal means adjacent said top piston end.

24. The invention of claim 20 including annular seat means formed on said piston valve means and said piston means for seating said piston valve means on said piston means.

25. The invention of claim 20 including resilient means normally urging said piston valve means into sealing engagement with said piston means until said means on said inner body engages said valve means.

26. The invention of claim 20 wherein said means on said inner body at one end thereof forms seat means for said valve member.

27. The invention of claim 26 including resilient means normally urging said valve member into sealing engagement with said seat means until said piston means moves said valve member off said seat means.

28. The invention of claim 20 including resilient means in the chamber urging said piston means away from said valve member and yieldable as said piston means moves to engage said valve member.

29. The invention of claim 21 wherein said valve member is slidably and sealably carried by said inner body.

30. The invention of claim 28 wherein said resilient means urging said piston means away from said valve member also engages said power piston and is yieldable upon movement of said piston means relative to said power piston.

31. The invention of claim 20 wherein said piston valve means is slidably and sealably carried by said inner body.

32. The invention of claim 20 wherein said piston means is slidably and sealably carried in said chamber.

33. The invention of claim 20 wherein the by-pass flow passage means is formed in said inner body.

34. The invention of claim 21 wherein one of said cross sectional areas is defined by seal means between said piston valve means and inner body and seal means between said piston means and outer body, and the other of said cross sectional areas is defined by seal means between said piston means and outer body and seal means between said piston means and inner body.

35. The invention of claim 21 wherein said cross sectional areas are of a predetermined relationship for maintaining the compressed hydraulic fluid pressure differential across said piston means within a predetermined range.

36. The invention of claim 20 wherein said flow by-pass means includes flow regulator means whereby the compressed hydraulic fluid moves therethrough at a constant rate within the predetermined pressure differential.

37. In a well bore fishing string hydraulic fishing jar having inner and outer telescopically interengaged bodies with a hydraulic fluid chamber therebetween having at least three associatable fluid chamber members and power piston means in the chamber to compress and apply a predetermined force to the hydraulic fluid in the chamber upon tensioning the fishing string for telescopic movement of the bodies to a plurality of said fluid chamber members, the improvement comprising:

(a) by-pass flow passage means in one of the bodies;

(b) a fluid metering member in the chamber in association with one end of the by-pass flow passage means from the compressed fluid in the chamber and operational so that compressed hydraulic fluid is selectively released to the by-pass flow passage means;

(c) piston means including pressure relief means to transfer the compressed hydraulic fluid within one of said plurality of hydraulic fluid chamber members to another of said plurality of hydraulic fluid chamber members across said piston means and thereby move it in the fluid chamber at forces in excess of a predetermined force applicable to said jar, to open the by-pass flow passage means at one end to the compressed hydraulic fluid;

(d) said piston means including valve means in the chamber normally closing off the other end of the by-pass flow passage means and shiftable to open so that hydraulic fluid is released from the chamber above said piston means; and (e) hammer and anvil means on said bodies movable into engagement when said fluid metering member and piston valve means open the by-pass passage means to the chamber across said piston means.

38. The invention of claim 37 wherein said piston means includes seal means sealably and slidably engaged in the chamber to provide cross sectional areas of different size on said piston means responsive to the compressed hydraulic fluid in the chamber for transfer thereof across said piston means.

39. The invention of claim 38 wherein one of said cross sectional areas is defined by seal means between said piston means and inner body and seal means between said piston means and outer body, and the other of said cross sectional areas is defined by seal means between said piston means and outer body and seal means between said piston means and inner body.

40. The invention of claim 38 wherein said cross sectional areas are of a predetermined relationship for maintaining the compressed hydraulic fluid pressure differential across said piston means within a predetermined range.

41. The invention of claim 37 wherein said flow by-pass means includes substantially constant flow regulator means whereby the compressed hydraulic fluid moves therethrough at a rate within the predetermined pressure differential.

42. In a hydraulic fishing jar adapted to be run into a well on a fishing string and connected to a fishing tool in the well bore;

(a) inner and outer telescopically interengaged bodies;

(b) means defining between said bodies a hydraulic fluid chamber having three associatable fluid chamber members;

(c) means in the chamber operable upon tensioning the fishing string for telescopic movement of said bodies to compress and apply a predetermined force to two of said fluid chamber members;

(d) there being by-pass flow passage means in one of said bodies;

(e) valve means in the chamber for normally closing off one end of the by-pass flow passage means from the compressed fluid in the chamber and responsively activatable to open so that compressed hydraulic fluid is released to the by-pass flow passage means;

(f) flow by-pass means to transfer the compressed hydraulic fluid in the chamber and thereby move said fluid in said chamber to engage and move said valve means to open the by-pass flow passage means at one end to the compressed hydraulic fluid upon application of said predetermined force;

(g) pressure relief means activatable at forces substantially in excess of said predetermined force to meter fluid therethrough and to transfer fluid pressure resulting from said excess force and within one of said two hydraulic fluid chamber members to the other of said two hydraulic chamber members whereby said valve is engaged and moved to open the by-pass flow passage means at one end of the compressed hydraulic fluid chamber; and (h) hammer and anvil means on said bodies movable into engagement when said valve member and valve means open the by-pass passage means to the chamber across said flow by-pass means.

43. The invention of claim 42 wherein said flow by-pass means includes piston means, said piston means having seal means sealably and slidably engaged in the chamber to provide cross sectional areas of different size on said piston means responsive to the compressed hydraulic fluid in the chamber for transfer thereof across said piston means.

44. The invention of claim 43 wherein said cross sectional areas are of a predetermined relationship for controlling the compressed hydraulic fluid pressure differential across said piston means in the chamber acting to move said piston means.

45. The invention of claim 43 wherein said piston means is an annular member having top and bottom ends and wherein the cross sectional area defined by said seal means adjacent said bottom piston end is smaller than the cross sectional area defined by said seal means adjacent said top piston end.

46. The invention of claim 43 including resilient means in the chamber urging said piston means away from said valve means and yieldable as said piston means moves to engage said valve means.

47. The invention of claim 46 wherein said resilient means urging said piston means away from said valve means also engages said means in the chamber operable upon tensioning the fishing string and is yieldable upon movement of said piston means relative to said means in chamber operable upon tensioning the fishing string.

48. The invention of claim 42 wherein said means defining the hydraulic fluid chamber comprises upper and lower seal means between said bodies, one of said seal means being a floating piston for compensating for the pressure of fluid in the well.

49. The invention of claim 42 wherein said valve means is slidably and sealably carried by said inner body.

50. The invention of claim 42 wherein said valve means is slidably and sealably carried by said outer body.

51. The invention of claim 42 wherein said by-pass flow passage means is formed in said outer body.

52. The invention of claim 42 wherein said by-pass flow passage means is formed in said inner body.

53. The invention of claim 43 wherein said piston means is slidably and sealably carried in said chamber.

54. The invention of claim 43 wherein one of said cross sectional areas is defined by seal means between said piston means and inner body and seal means between said piston means and outer body, and the other of said cross sectional areas is defined by seal means between said piston means and outer body and seal means between said piston means and inner body.

55. The invention of claim 43 wherein said cross sectional areas are of a predetermined relationship for maintaining the compressed hydraulic fluid pressure differential across said piston means within a predetermined range.

56. The invention of claim 42 wherein said flow by-pass means includes flow regulator means whereby compressed hydraulic fluid is movable therethrough within the predetermined pressure differential.

57. The invention of claim 42 wherein said flow regulator means is flow reversible.

58. The invention of claim 43 further comprising a flow reversible element for transmission of fluid in the chamber above said piston means to the chamber below the piston means.

59. The invention of claim 58 wherein said flow reversible element comprises a check valve.

60. The invention of claim 42 further comprising a flow reversible element for transmission of fluid in the chamber below the valve means to the chamber above the valve means.

61. In a well bore fishing string hydraulic fishing jar having inner and outer telescopically interengaged bodies with the hydraulic fluid chamber therebetween having three associatable fluid chamber members and power piston means in the chamber to compress and apply a predetermined force to the hydraulic fluid in the chamber upon tensioning the fishing string for telescopic movement of the bodies to two of said fluid chamber members, the improvement comprising:

(a) by-pass flow passage means in one of the bodies;

(b) a fluid metering member in the chamber in association with one end of the by-pass flow passage means from the compressed fluid in the chamber and operational so that compressed hydraulic fluid is selectively released to the by-pass flow passage means;

(c) piston means including relief means to transfer the compressed hydraulic fluid within one of said two hydraulic fluid chamber members to the other of said two hydraulic fluid chamber members across said piston means and thereby move it in the fluid chamber at forces in excess of a predetermined force applicable to said jar, to open the by-pass flow passage means at one end to the compressed hydraulic fluid;

(d) said piston means including valve means in the chamber normally closing off the other end of the by-pass flow passage means and shiftable to open so that hydraulic fluid is released from the chamber above said piston means; and (e) hammer and anvil means on said bodies movable into engagement when said fluid metering member and piston valve means open the by-pass passage means in the chamber across said piston means.

62. The invention of claim 61 wherein said piston means includes seal means sealably and slidably engaged in the chamber to provide cross sectional areas of different size on said piston means responsive to the compressed hydraulic fluid in the chamber for transfer thereof across said piston means.

63. The invention of claim 61 wherein said flow by-pass means includes substantially constant flow regulator means whereby the compressed hydraulic fluid moves therethrough at a rate within the predetermined pressure differential.

64. In a hydraulic fishing jar adapted to be run into a well on a fishing string and connected to a fishing tool in the well bore:

(a) inner and outer telescopically interengaged bodies;

(b) means defining between said bodies a hydraulic fluid chamber;

(c) means in the chamber operable upon tensioning the fishing string for telescopic movement of said bodies to compress and apply a predetermined force to the hydraulic fluid in the chamber;

(d) there being by-pass flow passage means in one of said bodies;

(e) valve means in the chamber for normally closing off one end of the by-pass flow passage means from the compressed fluid in the chamber and responsively activatable to open so that compressed hydraulic fluid is released to the by-pass flow passage means;

(f) flow by-pass means to transfer the compressed hydraulic fluid in the chamber and thereby move said fluid in said chamber to engage and move said valve means to open the by-pass flow passage means at one end to the compressed hydraulic fluid upon application of said predetermined force;

(g) pressure relief means activatable at forces substantially in excess of said predetermined force to meter fluid therethrough and to transfer fluid pressure resulting from said excess force and within said chamber whereby said valve is engaged and moved to open the by-pass flow passage means at one end of the compressed hydraulic fluid chamber; and (h) hammer and anvil means on said bodies movable into engagement when said valve member and valve means open the by-pass passage means to the chamber across said flow by-pass means.

65. The invention of claim 64 wherein said flow by-pass means includes piston means, said piston means having seal means sealably and slidably engaged in the chamber to provide cross sectional areas of different size on said piston means responsive to the compressed hydraulic fluid in the chamber for transfer thereof across said piston means.

66. The invention of claim 65 wherein said cross sectional areas are of a predetermined relationship for controlling the compressed hydraulic fluid pressure differential across said piston means in the chamber acting to move said piston means.

67. The invention of claim 65 wherein said piston means is an annular member having top and bottom ends and whereby the cross sectional area defined by said seal means adjacent said bottom piston end is smaller than the cross sectional area defined by said seal means adjacent said top piston end.

68. The invention of claim 65 including resilient means in the chamber urging said piston means away from said valve means and yieldable as said piston means moves to engage said valve means.

69. The invention of claim 68 wherein said resilient means urging said piston means away from said valve means also engages said means in the chamber operable upon tensioning the fishing string and is yieldable upon movement of said piston means relative to said means in the chamber operable upon tensioning the fishing string.

70. The invention of claim 64 wherein said means defining the hydraulic fluid chamber comprises upper and lower seal means between said bodies, one of said seal means being a floating piston for compensating for the pressure of fluid in the well.

71. The invention of claim 64 wherein said valve means is slidably and sealably carried by said inner body.

72. The invention of claim 64 wherein said valve means is slidably and sealably carried by said outer body.

73. The invention of claim 64 wherein said by-pass flow passage means is formed in said outer body.

74. The invention of claim 64 wherein said by-pass flow passage means is formed in said inner body.

75. The invention of claim 65 wherein said piston means is slidably and sealably carried in said chamber.

76. The invention of claim 65 wherein one of said cross sectional areas is defined by seal means between said piston means and inner body and seal means between said piston means and outer body, and the other of said cross sectional areas is defined by seal means between said piston means and outer body and seal means between said piston means and inner body.

77. The invention of claim 65 wherein said cross sectional areas are of a predetermined relationship for maintaining the compressed hydraulic fluid pressure differential across said piston means within a predetermined range.

78. The invention of claim 64 wherein said flow by-pass means includes flow regulator means whereby compressed hydraulic fluid is movable therethrough within the predetermined pressure differential.

79. The invention of claim 78 wherein said flow regulator means is flow reversible.

80. The invention of claim 65 further comprising a flow reversible element for transmission of fluid in the chamber above said piston means to the chamber below said piston means.

81. The invention of claim 79 wherein said flow reversible element comprises a check valve.

82. The invention of claim 64 further comprising a flow reversible element for transmission of fluid in the chamber below the valve means to the chamber above the valve means.

* * * * *